US005654552A

United States Patent [19]

Toombs

[11] Patent Number: 5,654,552

[45] Date of Patent: Aug. 5, 1997

[54] GLOW-IN-THE-DARK LAMP SHADE

[76] Inventor: Virginia L. Toombs, 28 Rivermead Ct., Marlow Bridge La., Marlow Bucks, United Kingdom, SL7 1SJ

[21] Appl. No.: 392,124

[22] Filed: Feb. 22, 1995

[51] Int. Cl.[6] ..... F21K 2/00

[52] U.S. Cl. ..... 250/462.1; 250/466.1; 362/84

[58] Field of Search ..... 250/462.1, 463.1, 250/464.1, 465.1, 466.1; 362/84

[56] References Cited

U.S. PATENT DOCUMENTS

| | | | |
|---|---|---|---|
| 1,342,767 | 6/1920 | Schlesinger . | |
| 1,585,379 | 5/1926 | Dixon . | |
| 1,840,419 | 1/1932 | Walling . | |
| 2,000,985 | 5/1935 | Quinlan et al. | 362/84 |
| 2,125,780 | 8/1938 | Goggin | 40/134 |
| 2,155,449 | 4/1939 | Seaman | 250/72 |
| 5,388,039 | 2/1995 | Dolph | 362/154 |
| 5,408,396 | 4/1995 | Stanley | 362/253 |

OTHER PUBLICATIONS

"In Re James N. Mason", Decisions in Patent and Trademark Cases, U.S. Court of Customs and Patent Appeals, No. 7205, 51CCPA; 331F.2d608; 141 USPQ521, (May 1964).

"Luminescent 'Lucite'", Scientific American p. 35 (Jan., 1947).

Label, "Night Glo™" ink, Hunt Manufacturing Co., Statesville, North Carolina.

*Primary Examiner*—David P. Porta
*Assistant Examiner*—Richard Hanig

[57] ABSTRACT

A lamp shade or similar article includes a glow-in-the-dark region with a first side disposed toward a light source so that the light source illuminates the first side and with a second side disposed away from the light source. The glow-in-the-dark region includes a glow-in-the-dark substance that stores energy from illumination and that responds to the stored energy by emitting light in the visible range. A portion of the light emitted by the glow-in-the-dark substance exits from the second side. If the first side is illuminated with sufficient intensity, the light exiting from the second side after illumination ceases is sufficient to be perceptible by a human in ambient darkness. The glow-in-the-dark substance can be a glow-in-the-dark ink applied to a cloth layer that is bonded to a transparent plastic layer of the lamp shade. The glow-in-the-dark ink can form a pattern that is bounded by an edge, and the surrounding background can include another colorant. If the background colorant has a darker absorption color than the glow-in-the-dark ink, the pattern will be visible as a light pattern on a dark background both during illumination and after illumination ceases. If the background colorant has approximately the same absorption color as the glow-in-the-dark ink, the pattern will not be visible during illumination, but will emerge as a light pattern on a dark background after illumination ceases.

13 Claims, 5 Drawing Sheets

GLOW-IN-THE-DARK LAMP SHADE

Dixon, U.S. Pat. No. 1,585,379, describes a lamp shade that gives different optical, color, and luminous effects when lighted and unlighted. As shown and described in relation to FIGS. 1 and 2, the lamp shade is covered with fabric sufficiently transparent to reveal designs on its body and is provided with walls or coatings that, when light is applied within, give the effect of translucent stained glass or crystals, also bringing out color effects not visible when the shade is unlighted. The lamp shade has a backing or body of fabric and has, on either side, a coating of small glass beads or crystals with an outer covering or decorative fabric thereover.

SUMMARY OF THE INVENTION

The invention is based on the discovery of techniques for providing lamp shades and similar articles of manufacture that glow in the dark. The techniques employ glow-in-the-dark substances that store energy from illumination and respond to the stored energy by emitting light in the visible range. If illumination exceeds a threshold intensity and then ceases, such glow-in-the-dark substances continue to emit light over a sufficient period of time that they glow in the dark. An example of such a substance is glow-in-the-dark ink.

An article of manufacture according to the techniques can include a support structure for supporting the article in relation to a light source. A light-receiving structure is attached to the support structure. A first side of the light-receiving structure is disposed toward the light source so that it can be illuminated by the light source. A second side is disposed away from the light source. A region of the light-receiving structure includes a glow-in-the-dark substance as described above, such as glow-in-the-dark ink. A portion of the light emitted by the glow-in-the-dark substance exits from the second side. The portion is sufficient that, if the region is illuminated with sufficient intensity, light exiting the second side after illumination ceases is perceptible in ambient darkness. In other words, the region glows in the dark, and is therefore referred to herein as a "glow-in-the-dark region."

An article according to the techniques can, for example, include a layer of fabric with glow-in-the-dark ink on the fabric in the glow-in-the-dark region. If the article is a lamp shade, the light-receiving structure can also include a transparent plastic layer at the first side, bonded to the fabric so that illumination of the glow-in-the-dark region from the first side reaches the glow-in-the-dark ink.

In one of the techniques, only the glow-in-the-dark substance is applied to the glow-in-the-dark region. As a result, when the article is viewed under illumination in the visible range, the glow-in-the-dark region has a color resulting from the absorption spectrum of the glow-in-the-dark substance.

In another technique, a background colorant covers a background region around the edge of the glow-in-the-dark region. The background colorant can have a similar absorption spectrum to the glow-in-the-dark substance, so that the glow-in-the-dark region and the background region are approximately the same color under illumination in the visible range, with the edge only becoming perceptible when illumination ceases. Or the background colorant can be sufficiently darker that the glow-in-the-dark region is perceptible as a light figure on a dark background, both under illumination and after illumination ceases.

The techniques described above are advantageous because they provide lamp shades and other such articles that glow in the dark. Such a lamp shade can be comforting to a child who is afraid of darkness, by providing a familiar image. Such a lamp shade can also help a person to navigate in a dark room after lights are turned out, by providing a reference point.

These and other aspects, features, objects, and advantages of the invention are described below in relation to the figures.

DETAILED DESCRIPTION

A. Conceptual Framework

The following conceptual framework is helpful in understanding the broad scope of the invention, and the terms defined below have the indicated meanings throughout this application, including the claims.

The term "light" is used herein to apply to all electromagnetic radiation.

A "human viewer" of light is a human with normal visual perception who is viewing the light.

"Light in the visible range" means light in the range of frequencies that can be visually perceived by a human viewer.

Unless otherwise specified, to "illuminate" is to provide light in any part of the frequency spectrum. An object "receives" illumination if light comes to the object. A light source "illuminates" an object by providing light that the object receives.

"Ambient darkness" describing a condition of lower illumination, can be contrasted with "ambient light," a condition of higher illumination. In ambient darkness, illumination is typically so low that a human viewer cannot see objects that are not emitting light. In ambient light, illumination is sufficient that a human viewer can see non-emitting objects.

A substance "glows in the dark" if the substance stores energy from illumination and responds to the stored energy after illumination ceases by emitting light in the visible range; if the substance is illuminated with sufficient intensity, the light emitted after illumination ceases can be perceptible to a human viewer in ambient darkness. A "glow-in-the-dark substance" is a substance that glows in the dark if sufficiently illuminated. A "glow-in-the-dark ink" is an ink that includes a glow-in-the-dark substance.

Light "exits" an object by coming out of and going away from the object.

A "colorant" is a substance that provides a color. Examples include inks, dyes, pigments, paints, stains, and so forth.

An "absorption color" is a color provided by a colorant as a result of the colorant's absorption spectrum, meaning the frequencies of light that the colorant absorbs. Two absorption colors are "approximately the same" if a human viewer of both absorption colors is unable to perceive a difference in color. A first colorant's absorption color is "darker" than a second colorant's if the first colorant absorbs more light in the visible range than the second, so that the first colorant is perceived as darker by a human viewer when both colorants are equally illuminated.

A region is perceptible as a "figure on a background" when a human viewer of the region and a surrounding background region sees a figure in front of a background.

B. General Features

Figure 1:
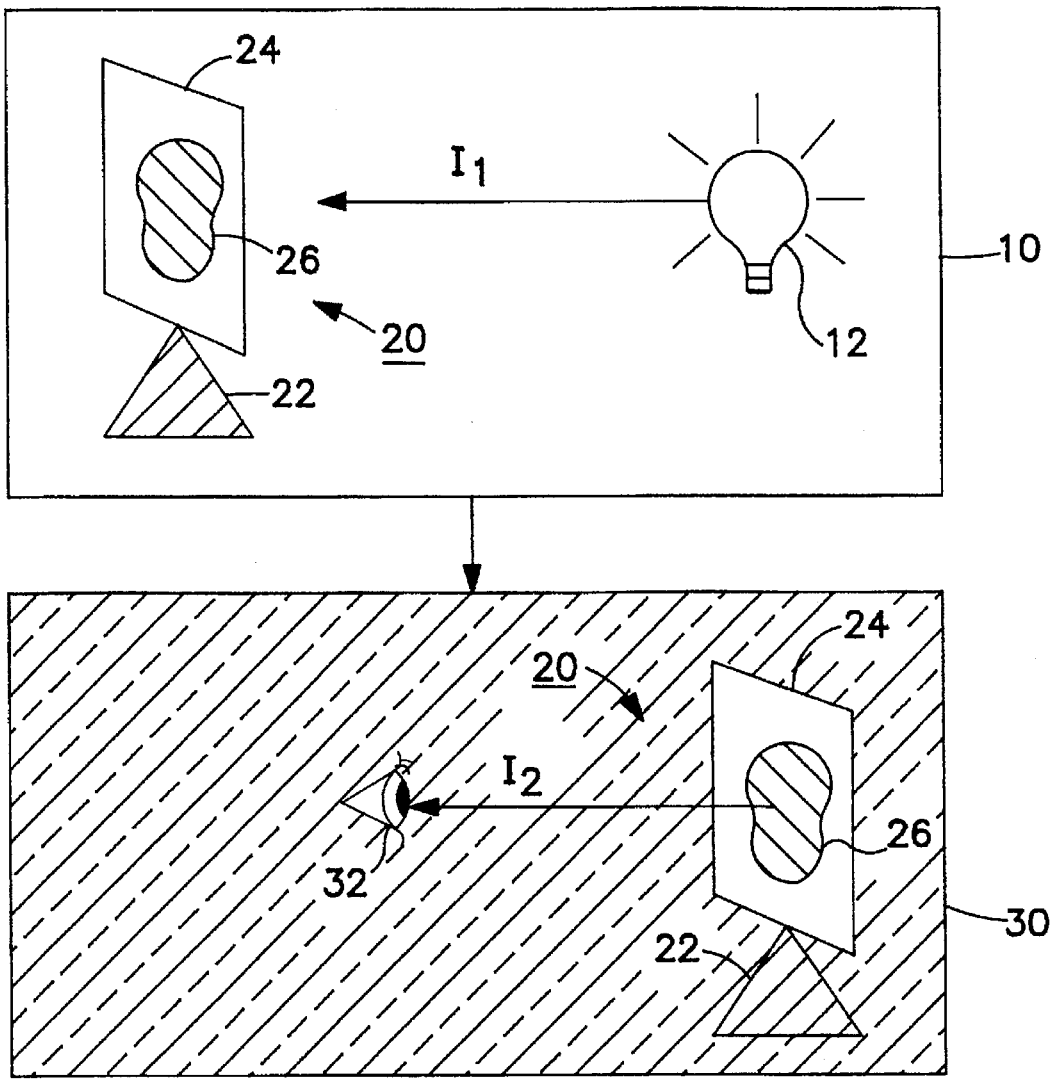
FIG. 1 is a schematic flow diagram showing stages during and after illumination of an article with a glow-in-the-dark region.
Figure 2A:
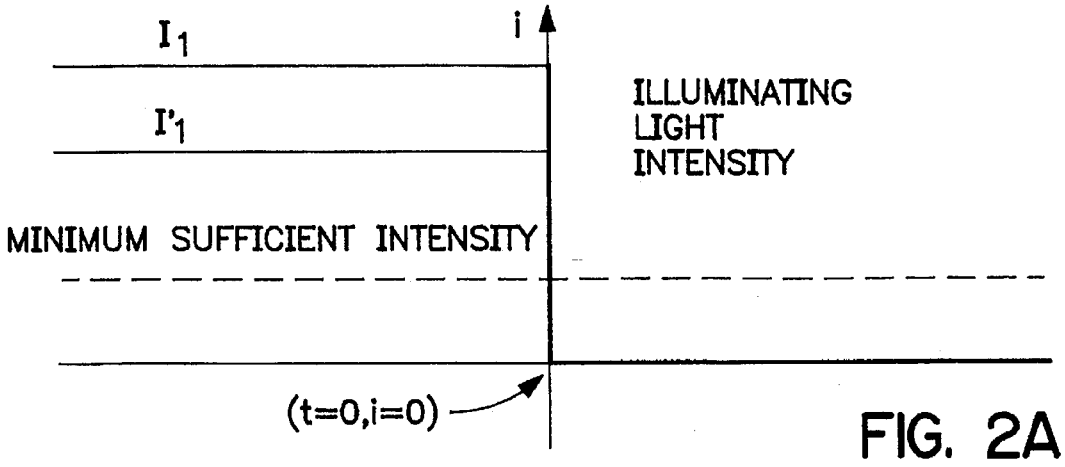
FIG. 2 is a timing diagram showing intensities of illuminating, emitted, and exiting light from the glow-in-the-dark region of FIG. 1.
Figure 2B:
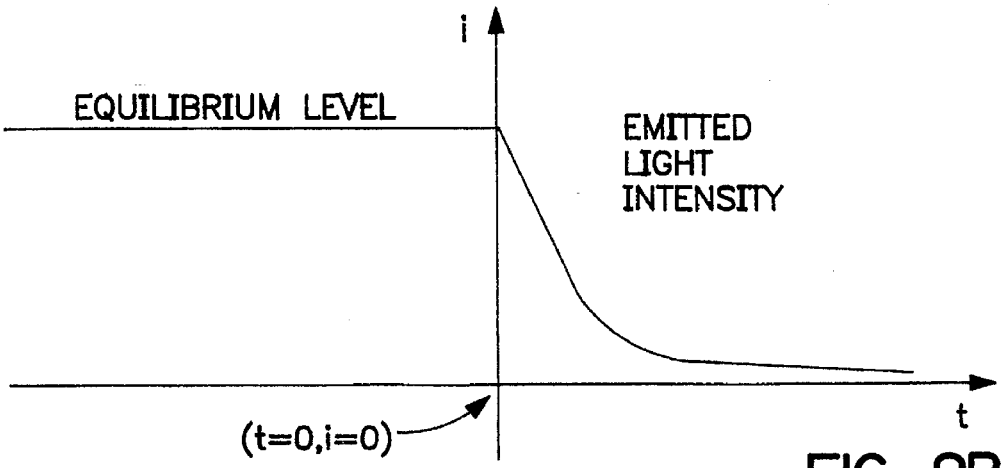
Figure 2C:
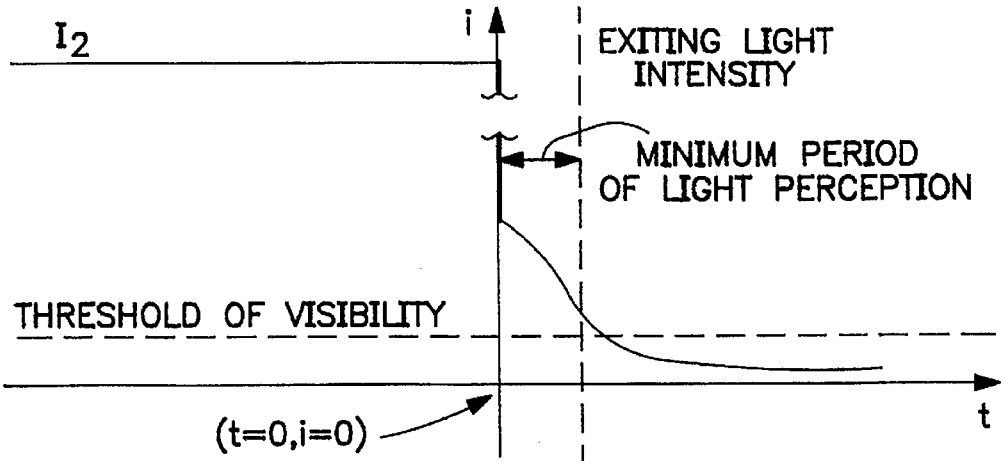

FIGS. 1 and 2 illustrate general features of the invention. FIG. 1 shows schematically how a glow-in-the-dark region of an article glows in the dark after illumination ceases. FIG. 2 shows intensities of illuminating, emitted, and exiting light before and after illumination ceases.

In illumination stage 10 in FIG. 1, light source 12 illuminates article 20. Article 20 includes support structure 22 that supports article 20 in relation to light source 12. Article 20 also includes light-receiving structure 24 with glow-in-the-dark region 26.

A first side of light-receiving structure 24 is disposed toward light source 12 and is therefore illuminated. A second, opposite side is disposed away from light source 12.

Light source 12 illuminates the first side of glow-in-the-dark region 26 at intensity $I_1$. As a result, a glow-in-the-dark substance in region 26 stores energy from the illuminating light and responds to the stored energy by emitting light in the visible range.

In darkness stage 30 in FIG. 1, light source 12 has ceased to illuminate article 20. The glow-in-the-dark substance in region 26 continues, however, to emit light. The portion of the emitted light exiting from the second side of region 26 has intensity $I_2$. Illumination intensity $I_1$ is sufficient that the exiting light at intensity $I_2$ is perceptible to human viewer 32 in ambient darkness. As a result, region 26 glows in the dark.

FIG. 2 shows in more detail the relationship between the intensities of illuminating, emitted, and exiting light in FIG. 1. The vertical scale represents intensity for each type of light, while the horizontal scale represents time. The three types of illumination have different intensity scales.

The upper curve in FIG. 2 shows intensity $I_1$ of light illuminating the glow-in-the-dark substance in region 26 as a function of time during illumination stage 10 and darkness stage 30 in FIG. 1. The two stages are separated by the vertical axis at t=0 in FIG. 2. Intensity $I_1$ illustrates the ideal case in which all of the illuminating light before t=0 reaches the glow-in-the-dark substance, but in a practical case the intensity $I_1$ of the illuminating light could be reduced by reflection or absorption by other layers of light-receiving structure 24, leaving a net intensity $I_1'$. As indicated by the minimum sufficient intensity, both $I_1$ and $I_1'$ are sufficient, however, that light exiting the second side of region 26 continues to be perceptible after illumination ceases at t=0.

The middle curve in FIG. 2 similarly shows the intensity of light emitted by the glow-in-the-dark substance. Within a short time after illumination begins, the intensity of emitted light rises to an equilibrium level at which the energy of emitted light just balances the energy being stored from illuminating light. Light continues to be emitted at the equilibrium level until illumination ceases at t=0. When illumination ceases, the intensity of emitted light decays from the equilibrium level, eventually reaching zero.

The lower curve in FIG. 2 similarly shows the intensity $I_2$ of the light that exits the second side of region 26. During illumination, i.e. before t=0, $I_2$ includes a first component from $I_1'$ and a second component from light emitted by the glow-in-the-dark substance. The intensity of the second component can be approximated as a fixed proportion of the emitted light in the middle curve, and is less than the emitted light intensity because some light is absorbed within light-receiving structure 24 or is reflected in other directions.

When illumination ceases at t=0, the first component, from $I_1'$, also ceases, so that only the second component remains. Therefore, $I_2$ drops significantly but remains above the threshold of visibility, i.e. the threshold or minimum intensity of visible light for human viewers with normal vision. Then intensity $I_2$ decays because the intensity of emitted light decays. But $I_2$ remains above the visibility threshold for longer than the minimum period of light perception, i.e. the minimum time for which light is perceptible by a human viewer with normal vision. As a result, region 26 glows in the dark.

C. Implementation

The general features described above could be implemented in many ways. Several prototype implementations have been produced by hand. The invention could also be implemented in production quantities.

C.1. Prototypes

Each of the prototypes has been produced by applying a conventional glow-in-the-dark ink, Speedball Night Glo™ Textile Inks, to a conventional laminated lamp shade that has an outer cloth layer and an inner plastic layer. Experiments have shown that applying the glow-in-the-dark ink to the cloth layer produces better results than applying it to the plastic layer.

Figure 3:
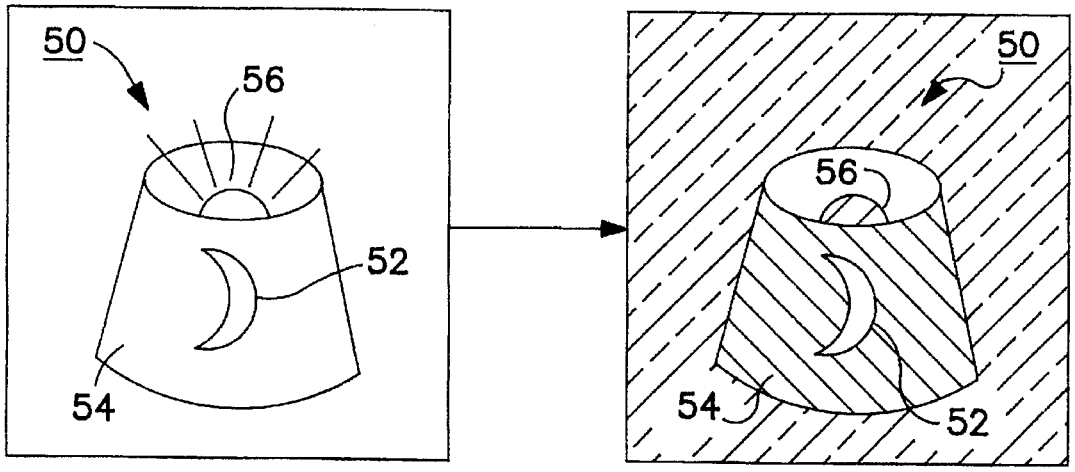
FIG. 3 is a schematic flow diagram showing stages during and after illumination of a lamp shade with a pattern of glow-in-the-dark ink.
Figure 4:
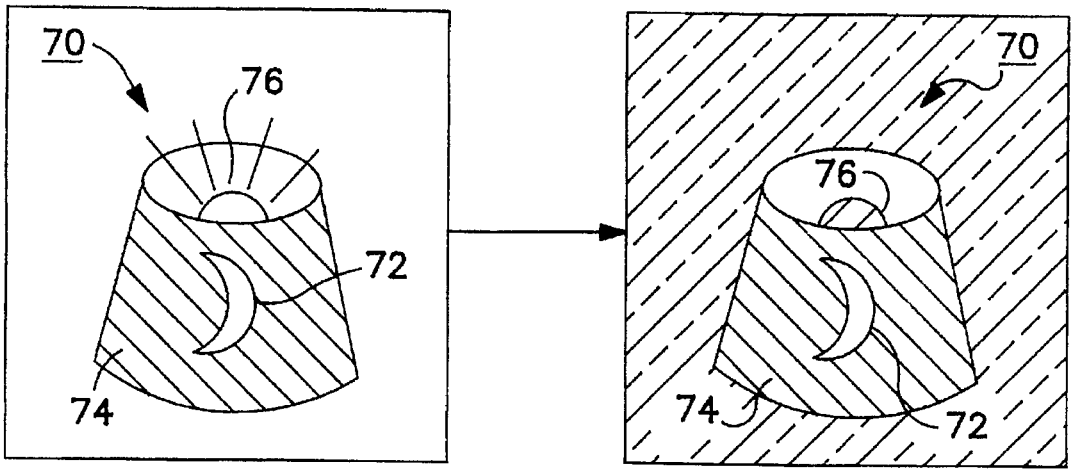
FIG. 4 is a schematic flow diagram showing stages during and after illumination of a lamp shade with a pattern of glow-in-the-dark ink and a background with a darker colorant.
Figure 5:
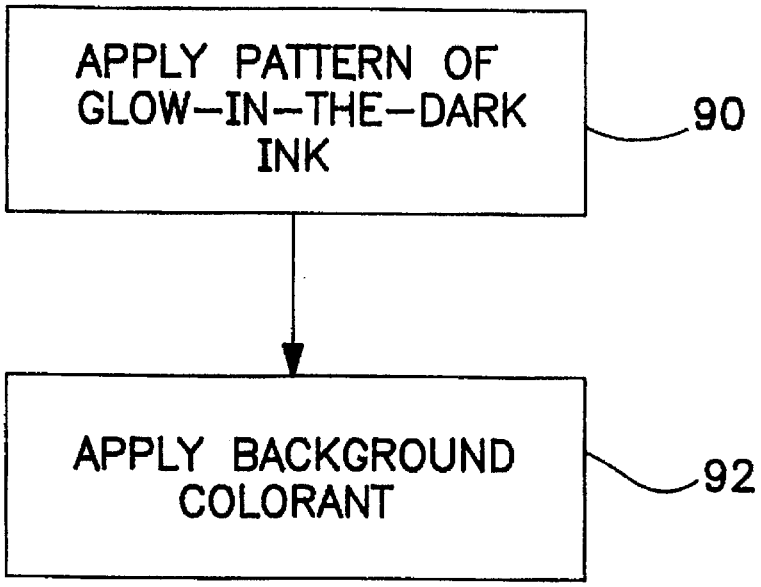
FIG. 5 is a flow chart showing acts in manually producing an article like the lamp shade of FIG. 4.
Figure 6:
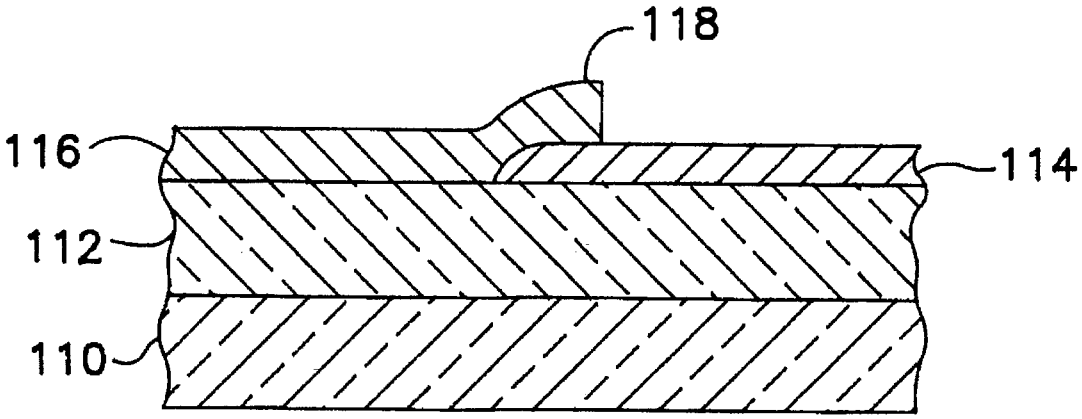
FIG. 6 is a schematic cross section of a precise edge of the background colorant in the lamp shade of FIG. 4.
Figure 7:
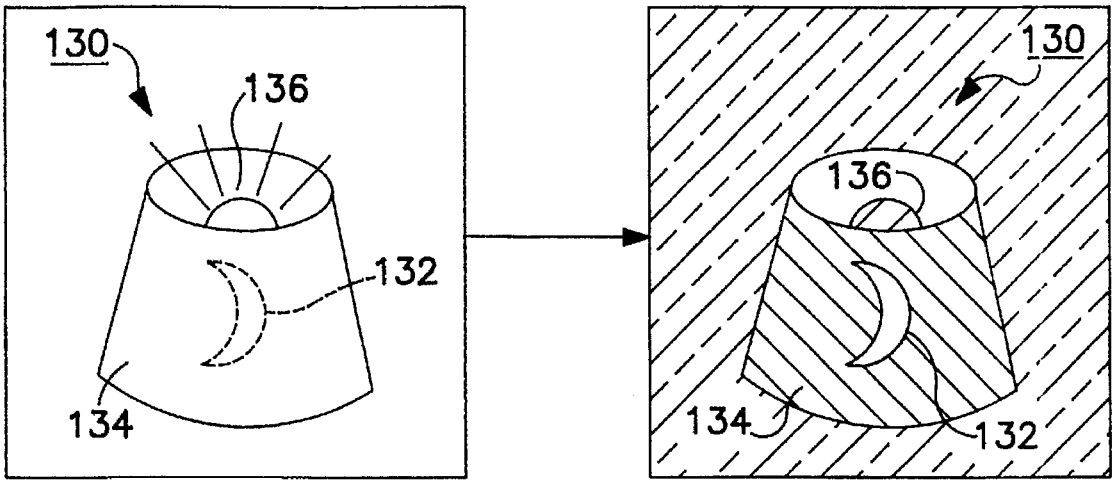
FIG. 7 is a schematic flow diagram showing stages during and after illumination of a lamp shade with a pattern of glow-in-the-dark ink and a background with a colorant that has approximately the same absorption color.

FIG. 3 shows a lamp shade with a pattern of glow-in-the-dark ink. FIG. 4 shows a lamp shade with a pattern of glow-in-the-dark ink on a background of a darker color. FIG. 5 shows acts in applying glow-in-the-dark ink and a background colorant. FIG. 6 shows a cross section of a precise edge. FIG. 7 shows a lamp shade with a pattern of glow-in-the-dark ink on a background of the same color.

FIG. 3 shows lamp shade 50 with pattern 52 formed by glow-in-the-dark ink. Pattern 52 is bounded by an edge that is surrounded by background 54. During illumination by light bulb 56, pattern 52 absorbs energy, as shown at left. When illumination ceases, a portion of emitted light from the glow-in-the-dark ink exits so that pattern 52 glows while background 54 is dark, as shown at right.

Pattern 52 illustratively has a crescent moon shape, but could have any shape, size, or position. In addition to prototypes with shapes as in FIG. 3, a prototype has been produced by applying glow-in-the-dark ink to a brush and then spraying the ink onto a lamp shade by dragging a finger across the brush to produce a spatter pattern.

As shown at left in FIG. 3, pattern 52 is also visible on background 54 during illumination. This occurs because glow-in-the-dark ink absorbs a different spectrum of light than background 54. Therefore, pattern 52 has a different color than background 54, so that it is visible as a figure on a background.

FIG. 4 shows lamp shade 70 with pattern 72 formed by glow-in-the-dark ink as in FIG. 3. The outer edge of pattern 72 is surrounded by background 74. A background colorant applied to background 74 has a darker absorption color than the glow-in-the-dark ink.

During illumination by light bulb 76, pattern 72 absorbs energy as in FIG. 3, but background 74 absorbs sufficient light that pattern 72 appears as a light figure on a dark background. When illumination ceases, a portion of emitted light from the glow-in-the-dark ink exits so that pattern 72 glows. But background 74 does not emit light after illumination ceases, so that pattern 72 again appears as the same light figure on a dark background.

The technique of FIG. 4 has been implemented in a number of lamp shades with patterns such as stars, a moon, and mountains on a dark blue background representing sky, or fish on a dark green background representing water. Various other patterns would be appropriate, such as animals or abstract shapes on dark backgrounds.

FIG. 5 illustrates acts performed in manually producing a lamp shade as in FIG. 4. The act in box 90 applies a pattern of glow-in-the-dark ink to a lamp shade. The act in box 92 applies a background colorant to the lamp shade. The acts in boxes 90 and 92 can be performed so that a precise edge is produced between the area that glows in the dark and the area that does not. For example, even though the edge of pattern 72 may not be precise, the background colorant can be applied over the edge of pattern 72 and can have a precise edge. If the background colorant absorbs sufficient light, pattern 72 appears to have a precise edge.

The technique of FIG. 5 has been implemented using a conventional laminated lamp shade, a cross section of which is shown schematically in FIG. 6. The lamp shade includes inner plastic layer 110 and outer cloth layer 112, bonded to inner layer 110. Glow-in-the-dark ink 114 is applied to outer layer 112 throughout a glow-in-the-dark region, but has an imprecise edge that extends beyond the edge of the glow-in-the-dark region. Background colorant 116 is also applied to outer layer 112 around the outer edge of the glow-in-the-dark region, with a precise edge 118 where background colorant 116 overlaps glow-in-the-dark ink 114. Although not shown in FIG. 6, the colorants could penetrate the cloth layer and fill in openings in its surface. As a result, the colorants might have a rough surface, which might increase the effective surface area through which emitted light can exit.

FIG. 7 illustrates a variation of FIG. 4 that has not yet been implemented. Lamp shade 130 has pattern 132 formed by glow-in-the-dark ink, surrounded by background 134. A background colorant applied to background 134 has approximately the same absorption color as the glow-in-the-dark ink.

During illumination by light bulb 136, pattern 132 absorbs energy as in FIG. 3 and background 134 absorbs approximately the same spectrum of light so that pattern 132 is not visible, as suggested by the dashed outline. When illumination ceases, a portion of emitted light from the glow-in-the-dark ink exits so that pattern 132 glows. But background 134 does not emit light after illumination ceases, so that pattern 132 emerges as a light figure on a dark background.

The technique of FIG. 7 could also be implemented as in FIG. 5. If a precise edge is desired, however, it may be necessary to avoid any overlap of the background colorant over the glow-in-the-dark ink as in FIG. 6.

C.2. Production

Figure 8:
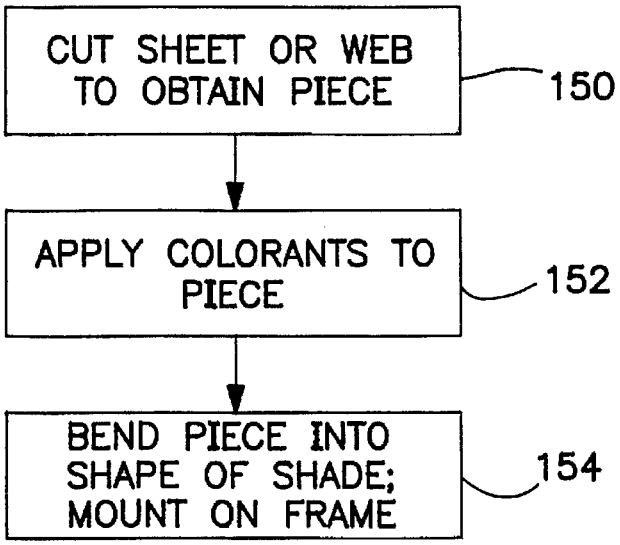
FIG. 8 is a flow chart showing acts in producing lamp shades that glow-in-the-dark in production quantities.

The techniques described above could be modified to produce lamp shades in production quantifies. FIG. 8 illustrates a modified technique that could be used.

The act in box 150 cuts a large sheet or web of material into appropriately shaped pieces for forming a lamp shade. The sheet or web can include bonded layers of plastic and cloth, as described above in relation to FIG. 6. The act in box 150 can be implemented with conventional techniques.

The act in box 152 applies colorants to a piece of material from box 150. The act in box 152 could be implemented using glow-in-the-dark inks and background colorants as described above.

To obtain a spatter pattern, a machine could be used to spray the piece of material. The machine could spray large or small droplets. The droplets could be uniformly or nonuniformly distributed. For example, droplets could be clustered to imitate galaxies of stars.

To produce a pattern of distinct objects, one could use silk screen printing, either by hand or machine. Two or more screens with complementary patterns could be used, applying the patterns in registration to obtain precise edges. Or the material could first be uniformly dyed with one colorant and then one or more other colorants could be applied with silk screens. For example, the material could be dyed with glow-in-the-dark ink, and then an opaque pattern could be applied by silk screening.

The act in box 154 then bends the pieces of material into the shape of a lamp shade and mounts it on rings and radial stays or any other appropriate support for mounting on a lamp. The act in box 154 can be implemented with conventional techniques, and can include applying tape or other material for structural or aesthetic purposes.

D. Variations

The implementations described above could be varied in numerous ways within the scope of the invention.

The above implementations use glow-in-the-dark ink, but other substances that store energy during illumination and then emit light after illumination ceases could be used.

The above implementations use lamp shades, but other articles could be used, including other light coveting articles including light diffusers, globes, and so forth. Also, the implementations could be used with various light sources.

Although the above implementations glow in the dark after being illuminated by the light source, the articles would also glow in the dark after being illuminated by ambient light. In either case, the article will only glow in the dark if illumination has sufficient intensity and ceases quickly enough that the subsequent glow can be perceived in ambient darkness.

The lamp shade implementations could be modified to include additional features. For example, colorants could be applied to an inner layer of a lamp shade so that it would appear differently when illuminated from within than when illuminated by ambient light. Shades of various shapes and styles, with various types of supporting flames could be used. Lamp shades made of various materials could be used.

The sequences of acts described above could be modified, such as by performing acts differently or in a different order. For example, in FIG. 5, the background colorant could be applied before the glow-in-the-dark ink. In FIG. 8, the sheet or web could be cut after colorants are applied, although this may make it more difficult to apply the colorants in registration. Also, the cloth layer could be dyed before it is bonded to the plastic layer.

E. Applications

The implementations described above could be applied to provide a lamp shade to comfort a child afraid of darkness or to assist a person in orienting in a dark room.

F. Miscellaneous

Although the invention has been described in relation to various implementations, together with modifications, variations, and extensions thereof, other implementations, modifications, and extensions are within the scope of the invention. The invention is therefore not limited by the description contained herein or by the drawings, but only by the claims.

I claim:

1. A lamp shade comprising:

a support structure for supporting the lamp shade on a lamp that includes a light source; and a light-receiving structure attached to the support structure; the light-receiving structure having a first side and a second side opposite the first side; the first side being disposed toward the light source so that the light source illuminates the first side; the second side being disposed away the light source so that light exiting the light-receiving structure's second side reaches a human viewer when the support structure supports the lamp shade on the lamp;

the light-receiving structure having a glow-in-the-dark region that includes a glow-in-the-dark ink; the glow-in-the-dark region being bounded by an edge;

the light-receiving structure further having a background region that meets the glow-in-the-dark region at the edge; the background region including a background colorant that does not glow in the dark;

the glow-in-the-dark ink receiving illumination from the light source that enters the glow-in-the-dark region; if illuminated with sufficient intensity, the glow-in-the-dark ink emitting light that exits from the light-receiving structure's second side in the glow-in-the-dark region so that when illumination ceases the glow-in-the-dark region's glow is perceptible to the human viewer in ambient darkness; the glow-in-the-dark ink and the background colorant being positioned at the edge so that the glow-in-the-dark region has a perceptible, precise edge in ambient darkness when viewed by the human viewer from the second side after illumination from the first side ceases;

the glow-in-the-dark ink having a first absorption color so that the glow-in-the-dark region is perceptible as having the first absorption color when illuminated in the visible range; the background colorant having a second absorption color that is sufficiently darker than the first absorption color that the glow-in-the-dark region is perceptible as a first light figure on a dark background when the light-receiving structure is illuminated in the visible range; the glow-in-the-dark region being perceptible as a second light figure on a dark background in ambient darkness after illumination ceases; the first and second figures being approximately the same.

2. A lamp shade comprising:

a support structure for supporting the lamp shade on a lamp that includes a light source; and a light-receiving structure attached to the support structure; the light-receiving structure having a first side and a second side opposite the first side; the first side being disposed toward the light source so that the light source illuminates the first side; the second side being disposed away from the light source so that light exiting the light-receiving structure's second side reaches a human viewer when the support structure supports the lamp shade on the lamp;

the light-receiving structure having a glow-in-the-dark region that includes a glow-in-the-dark substance that stores energy from illumination of the glow-in-the-dark region and that responds to the stored energy by emitting light in the visible range; the glow-in-the-dark region being bounded by an edge;

the light-receiving structure further having a background region that meets the glow-in-the-dark region at the edge; the background region including a background colorant that does not glow in the dark;

a portion of the light emitted by the glow-in-the-dark substance exiting from the light-receiving structure's second side; the portion exiting the light-receiving structure's second side being sufficient that, if the light-receiving structure's first side in the glow-in-the-dark region is illuminated with sufficient intensity, the light exiting the light-receiving structure's second side after illumination ceases is perceptible by the human viewer in ambient darkness; the glow-in-the-dark substance and the background colorant being positioned at the edge so that the glow-in-the-dark region has a perceptible, precise edge in ambient darkness when viewed by the human viewer from the second side after illumination from the first side ceases;

the glow-in-the-dark substance having a first absorption color so that the glow-in-the-dark region is perceptible as having the first absorption color when illuminated in the visible range; the background colorant having a second absorption color that is sufficiently darker than the first absorption color that the glow-in-the-dark region is perceptible as a first light figure on a dark background when the light-receiving structure is illuminated in the visible range; the glow-in-the-dark region being perceptible as a second light figure on a dark background in ambient darkness after illumination ceases; the first and second figures being approximately the same.

3. The lamp shade of claim 2 in which the light-receiving structure comprises:

a cloth layer; and a glow-in-the-dark ink on the cloth layer in the glow-in-the-dark region; the glow-in-the-dark ink being the glow-in-the-dark substance.

4. The lamp shade of claim 3 in which the light-receiving structure further comprises a transparent plastic layer at the light-receiving structure's first side; the cloth layer being at the light-receiving structure's second side; the transparent plastic layer and the cloth layer being bonded so that illumination of the glow-in-the-dark region from the light-receiving structure's first side reaches the glow-in-the-dark ink.

5. An article of manufacture comprising:

a support structure for supporting the article in relation to a light source; and a light-receiving structure attached to the support structure; the light-receiving structure having a first side and a second side opposite the first side; the first side being disposed toward the light source so that the light source illuminates the first side; the second side being disposed away from the light source so that light exiting the light-receiving structure's second side reaches a human viewer when the support structure supports the article in relation to the light source;

the light-receiving structure having a glow-in-the-dark region that includes a glow-in-the-dark substance that stores energy from illumination of the glow-in-the-dark region and that responds to the stored energy by emitting light in the visible range; the glow-in-the-dark region being bounded by an edge;

the light-receiving structure further having a background region that meets the glow-in-the-dark region at the edge; the background region including a background colorant that does not glow in the dark;

a portion of the light emitted by the glow-in-the-dark substance exiting from the light-receiving structure's second side; the portion exiting the light-receiving structure's second side being sufficient that, if the light-receiving structure's first side in the glow-in-the-dark region is illuminated with sufficient intensity, the light exiting the light-receiving structure's second side after illumination ceases is perceptible in ambient darkness; the glow-in-the-dark substance and the background colorant being positioned at the edge so that the glow-in-the-dark region has a perceptible, precise edge in ambient darkness when viewed by the human viewer from the second side after illumination from the first side ceases;

the glow-in-the-dark substance having a first absorption color so that the glow-in-the-dark region is perceptible as having the first absorption color when illuminated in the visible range; the background colorant having a second absorption color that is sufficiently darker than the first absorption color that the glow-in-the-dark region is perceptible as a first light figure on a dark background when the light-receiving structure is illuminated in the visible range; the glow-in-the-dark region being perceptible as a second light figure on a dark background in ambient darkness after illumination ceases; the first and second figures being approximately the same.

6. The article of claim 5 in which the light-receiving structure comprises:

a cloth layer; and a glow-in-the-dark ink on the cloth layer in the glow-in-the-dark region; the glow-in-the-dark ink being the glow-in-the-dark substance.

7. The article of claim 6 in which the light-receiving structure further comprises a transparent plastic layer at the light-receiving structure's first side; the cloth layer being at the light-receiving structure's second side; the transparent plastic layer and the cloth layer being bonded so that illumination of the glow-in-the-dark region from the light-receiving structure's first side reaches the glow-in-the-dark ink.

8. The article of claim 5 in which the glow-in-the-dark substance and the background colorant are precisely positioned in complementary registration at the edge.

9. The article of claim 5 in which the glow-in-the-dark substance has an imprecise edge that extends beyond the glow-in-the-dark region; the background colorant having a precise edge that overlaps the glow-in-the-dark substance.

10. The article of claim 5 in which the glow-in-the-dark substance uniformly covers the light-receiving structure; the background colorant being over the glow-in-the-dark substance and having a precise edge at the edge of the glow-in-the-dark region.

11. The article of claim 5 in which the article is a lamp shade; the support structure supporting the article on a lamp that includes the light source.

12. The article of claim 5 in which the glow-in-the-dark substance is glow-in-the-dark ink.

13. An article of manufacture comprising:

a support structure for supporting the article in relation to a light source; and a light-receiving structure attached to the support structure; the light-receiving structure having a first side and a second side opposite the first side; the first side being disposed toward the light source so that the light source illuminates the first side; the second side being disposed away from the light source when the support structure supports the article in relation to the light source;

the light-receiving structure having a glow-in-the-dark region that includes a glow-in-the-dark substance that stores energy from illumination of the glow-in-the-dark region and that responds to the stored energy by emitting light in the visible range; the glow-in-the-dark region being bounded by an edge;

the light-receiving structure further having a background region that meets the glow-in-the-dark region at the edge; the background region including a background colorant;

a portion of the light emitted by the glow-in-the-dark substance exiting from the light-receiving structure's second side; the portion exiting the light-receiving structure's second side being sufficient that, if the light-receiving structure's first side in the glow-in-the-dark region is illuminated with sufficient intensity, the light exiting the light-receiving structure's second side after illumination ceases is perceptible in ambient darkness;

the glow-in-the-dark substance having a first absorption color so that the glow-in-the-dark region is perceptible as having the first absorption color when illuminated in the visible range; the background colorant having a second absorption color that is sufficiently darker than the first absorption color that the glow-in-the-dark region is perceptible as a first figure on a background when the light-receiving structure is illuminated in the visible range; the glow-in-the-dark region being perceptible as a second figure on a background in ambient darkness after illumination ceases; the first and second figures being approximately the same.

* * * * *